US006087946A

United States Patent [19]

Menard, Jr.

[11] Patent Number: 6,087,946

[45] Date of Patent: Jul. 11, 2000

[54] CHRISTMAS TREE STAND

[76] Inventor: Wayne A. Menard, Jr., 3404 Broxton Mill Way, Snellville, Ga. 30039

[21] Appl. No.: 09/176,643

[22] Filed: Oct. 21, 1998

[51] Int. Cl.[7] ..... G08B 21/00

[52] U.S. Cl. ..... 340/618; 340/620; 340/628

[58] Field of Search ..... 340/620, 618, 340/623, 628, 521, 518; 248/523, 188.2, 151, 225.1; 324/694

[56] References Cited

U.S. PATENT DOCUMENTS

| | | | |
|---|---|---|---|
| 2,628,049 | 2/1953 | Hansson | 248/516 |
| 3,142,464 | 7/1964 | Zelenitz | 248/516 |
| 3,298,643 | 1/1967 | Taylor | 248/516 |
| 4,075,614 | 2/1978 | White | 340/594 |
| 4,090,178 | 5/1978 | Norris | 340/628 |
| 4,699,347 | 10/1987 | Kuhnley | 248/516 |
| 4,712,328 | 12/1987 | Gies | 248/516 |
| 4,796,017 | 1/1989 | Merenda | 340/620 |
| 4,850,137 | 7/1989 | Foster | 47/79 |
| 4,901,971 | 2/1990 | Connelly | 248/523 |
| 4,913,395 | 4/1990 | Juhas | 248/516 |
| 4,967,508 | 11/1990 | Reynolds | 47/40.5 |
| 4,993,176 | 2/1991 | Spinosa | 40/40.5 |
| 5,114,113 | 5/1992 | Krinner | 248/525 |
| 5,249,772 | 10/1993 | Montie, Jr. et al. | 248/523 |
| 5,396,221 | 3/1995 | Bridges | 340/628 |
| 5,428,348 | 6/1995 | Gault | 340/618 |
| 5,473,837 | 12/1995 | Skoczylas et al. | 47/40.5 |
| 5,493,277 | 2/1996 | Pierce et al. | 340/620 |
| 5,513,677 | 5/1996 | McCurry | 141/1 |
| 5,522,179 | 6/1996 | Hollis | 47/40.5 |
| 5,575,110 | 11/1996 | Couture | 47/40.5 |
| 5,625,345 | 4/1997 | Stark | 340/628 |
| 5,791,626 | 8/1998 | Reese | 248/523 |
| 5,835,018 | 11/1998 | Kursel et al. | 340/620 |

*Primary Examiner*—Daniel J. Wu
*Assistant Examiner*—Toan Pham
*Attorney, Agent, or Firm*—Kenneth L. Tolar

[57] ABSTRACT

A Christmas tree stand includes a substantially bowl shaped base component having a bottom wall, a continuous side wall depending therefrom and an open top in communication with an interior chamber. A fixed plate is vertically disposed within the interior chamber against which a tree trunk is placed. A pair of pneumatic telescoping arms are secured to the base component and extend into the interior chamber each having an engagement plate at a distal end. The telescoping arms are actuated with a foot pump in communication therewith allowing a user to conveniently thrust the engagement plates against the opposing portion of the tree trunk to secure the tree therein. The device also includes a fire alarm means and a water level sensing means.

3 Claims, 2 Drawing Sheets

CHRISTMAS TREE STAND

BACKGROUND OF THE INVENTION

The present invention relates to a uniquely configured Christmas tree stand that allows a tree to be quickly and conveniently mounted therein.

DESCRIPTION OF THE PRIOR ART

Mounting a Christmas tree within a conventional stand has always been cumbersome and difficult. The stand typically includes an upwardly extending collar for encompassing the tree trunk having a plurality of threaded bolts extending therethrough. Typically, the tree must be held upright by a first person while a second person kneels and tightens the bolts against the exterior of the tree trunk to secure the tree in an upright position. The cumbersome process must often be repeated numerous times in that, once the bolts are tightened, the user discovers that the tree is leaning.

The present invention provides a uniquely configured tree stand that allows a single user to place the tree trunk within the stand and quickly secure it therein without the assistance of another person. The device further includes a water level sensor and fire alarm for audibly or visually alerting a user if water should be added to the stand or if a fire is occurring.

Although various Christmas tree stands exist in the prior art, none have the unique features and advantages according to the present invention. For example, U.S. Pat. No. 2,628,049 issued to Hansson relates to a Christmas tree holder comprising a conical shaped receptacle surrounded by a frame which moves inwardly to engage a Christmas tree trunk when placed therein.

U.S. Pat. No. 3,142,464 issued to Zelenitz relates to a moistening Christmas tree holder comprising a water holding pan attached to a plurality of legs with a rod vertically depending therefrom. The rod is received with an axial bore in the bottom of the tree trunk to secure the tree to the holder.

U.S. Pat. No. 3,298,643 issued to Taylor relates to a tree stand comprising a collar with threaded screws extending therethrough. The collars are attached to a pan for receiving a distal end of a Christmas tree trunk.

U.S. Pat. No. 5,249,772 issued to Montie, Jr. et al relates to a Christmas tree stand comprising an inner portion securable to the Christmas tree trunk and a base portion which is adapted for receiving the inner portion and the trunk portion. The stand further includes an assembly for centering the inner portion and the bottom end of the tree trunk relative to the base portion.

U.S. Pat. No. 4,913,395 issued to Juhas relates to a Christmas tree stand comprising a water holding pan supported by arcuate legs having an adjustable, gimballed structure. The gimballed structure vertically positions a Christmas tree as much as fifteen degrees.

U.S. Pat. No. 4,712,328 issued to Gies relates to a Christmas tree stand having a casing with an inner wall of spirally curved surfaces, a guide piece and clamping members disposed therebetween. A cover is rotatably mounted over the top of the casings and is coupled to the clamping cylinders so that, when the cover is rotated, the clamping cylinders spirally close upon a tree trunk.

Although tree stands having various tree anchoring means exist in the prior art, none of these devices relate to a stand having a simple, easy-to-use foot activated tree restraining mechanism according to the present invention. Accordingly, a single user may place the tree trunk into the stand and quickly secure it therein without the assistance of a second person.

SUMMARY OF THE INVENTION

The present invention relates to a Christmas tree stand comprising a hollow, substantially bowl shaped base component having a bottom wall, a continuous side wall and an open top in communication with an interior chamber. Vertically received within the interior chamber is a fixed plate having a slightly arcuate configuration against which a tree trunk is placed. The side wall of the base component contains a pair of pneumatic cylinders with a first end extending outwardly from the base component and a second opposing end protruding into the interior chamber. Attached to the second end of each cylinder is an arcuate plate having a similar configuration to that of the fixed plate. A foot actuated air pump is attachable to each pneumatic cylinder for pumping air thereto to selectively extend the plates towards the tree trunk or to retract them therefrom. Accordingly, a Christmas tree trunk is inserted within the interior chamber between the three plates. Using the foot actuated air pump, the movable plates are thrust against the tree trunk thereby securing the tree in an upright position. The base component also includes a water level sensing means, a fire alarm means and a plurality of externally disposed electrical outlets with which auxiliary electrical devices may be conveniently coupled. It is therefore an object of the present invention to provide a Christmas tree stand that allows a user to quickly and conveniently secure a tree therein.

It is yet another object of the present invention to provide a Christmas tree stand that allows a single user to erect a tree.

It is yet another object of the present invention to provide a Christmas tree stand that emits an audible or visual alarm in the event of a fire or if the water in the stand diminishes below a predetermined level.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
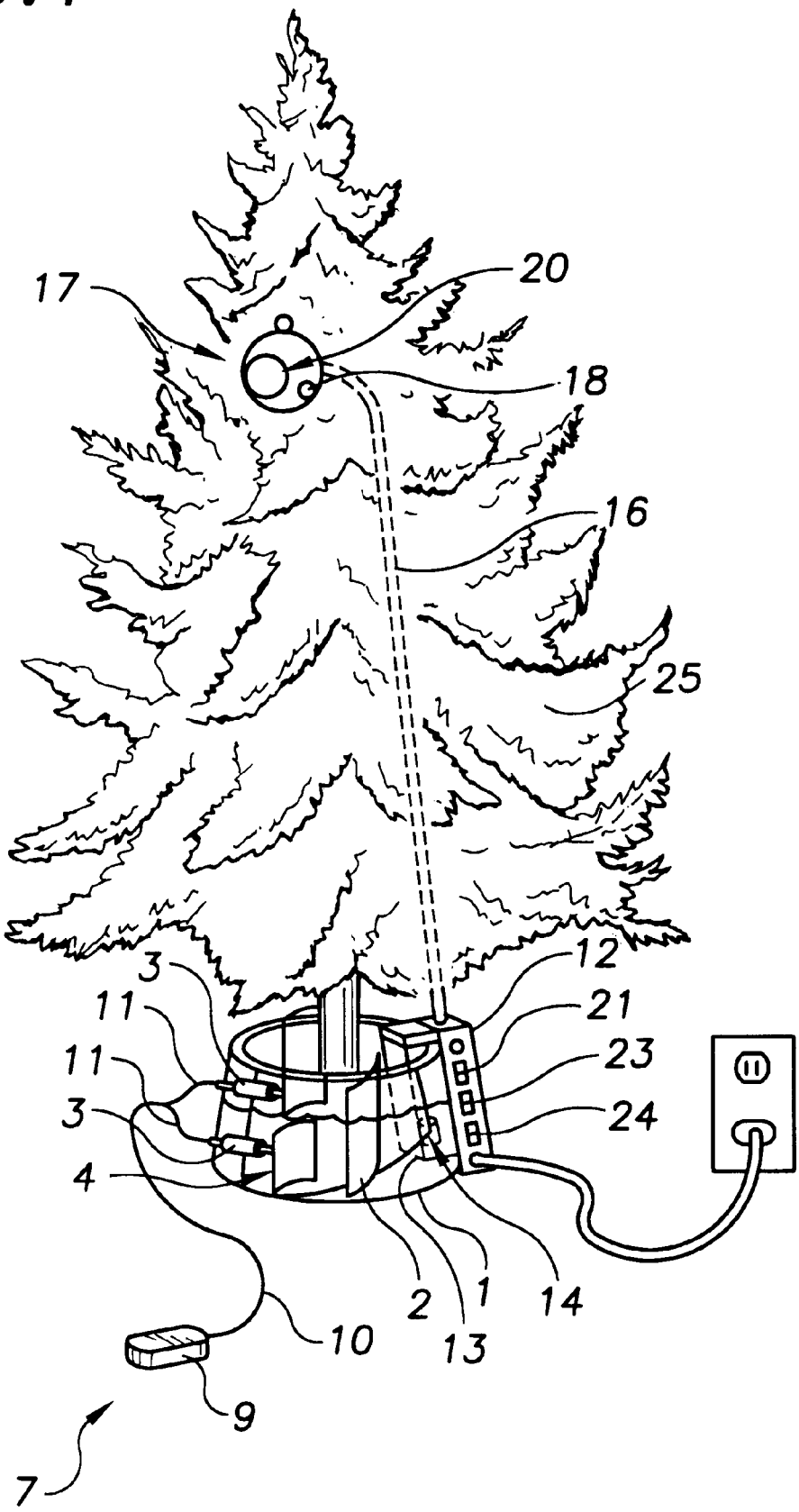
FIG. 1 depicts the inventive device with a tree mounted therein.
Figure 2:
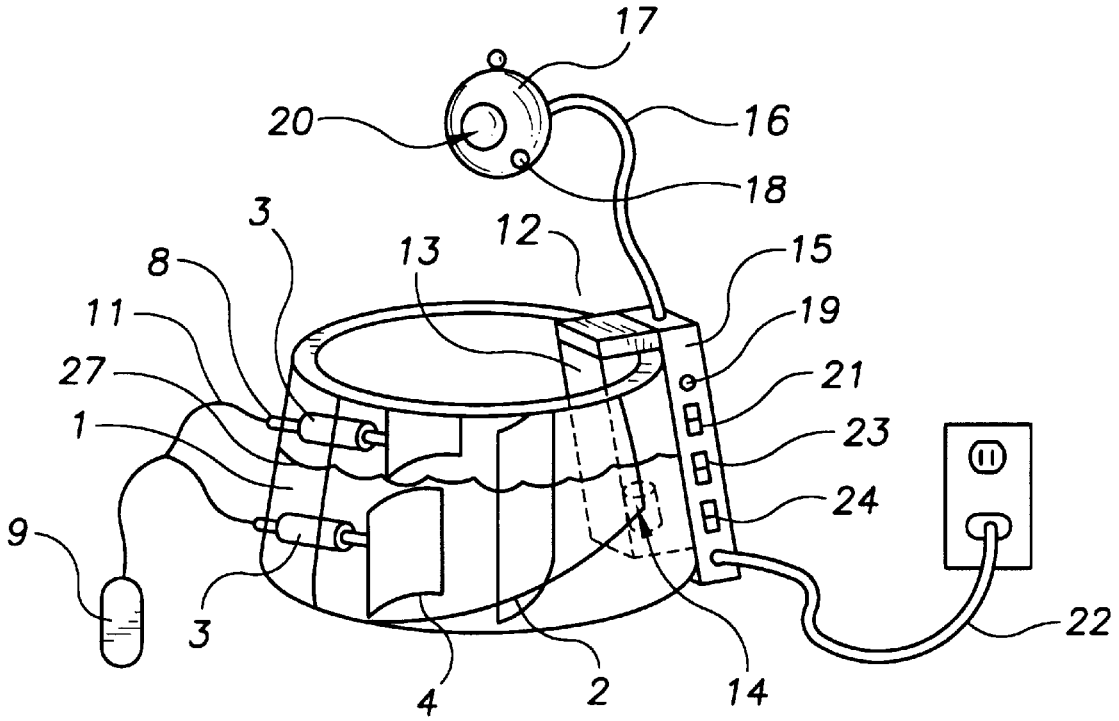
FIG. 2 is a perspective view of the inventive device depicting the internal components received therein.
Figure 3:
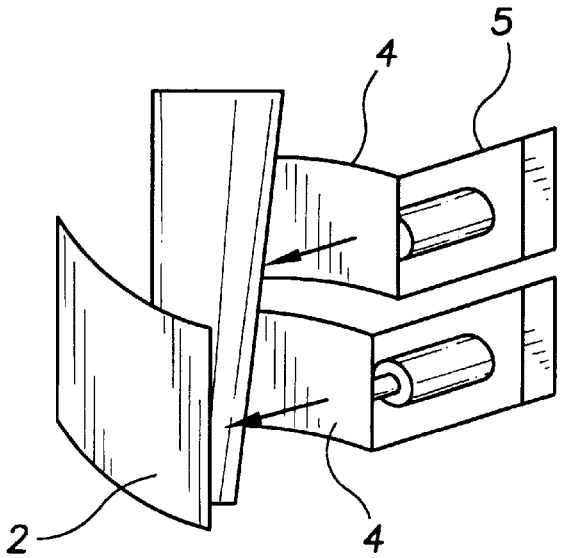
FIG. 3 is a close-up view of the tree restraining means according to the present invention.

Referring now to FIGS. 1 and 2, the present invention relates to a Christmas tree stand that allows a user to quickly and conveniently secure a tree 25 therein. The device comprises a hollow, substantially bowl shaped base component 1 having a bottom wall, a continuous side wall depending therefrom and an open top end in communication with an interior chamber. Received within the interior chamber is a substantially vertical, fixed plate 2 having a substantially planar but slightly arcuate configuration so that the plate conforms somewhat to the tree trunk when the trunk is placed thereagainst.

The side wall includes a pair of apertures each having a pneumatically operable telescoping arm 3 horizontally received therein, the first end of which extends outwardly from the base component with the opposing end extending into the interior chamber. Attached to each interiorly disposed end of the telescoping arm is a plate 4 having a substantially similar configuration as that of the fixed plate. Preferably, each plate slides within a pair of opposing guide rails 5 to support the plates and arm as the arm is extended or retracted and to prevent the plates from colliding. The opposing end of each arm includes a quick connect means 8 for establishing communication between an air pump and the arm. The arms relate to conventional pneumatic cylinders of the type generally known in the prior art.

The pump 7 relates to a dual mode air pump including a foot pump actuator 9 with a tube 10 or similar conduit attached thereto, the tube having a pair of ends 11. Each end of the tube may be removably attached to a quick connect means on an arm to deliver air thereto. Accordingly, a user pumps air to the arms using the foot actuated air pump thereby thrusting the plates against the trunk to rigidly support the tree in an upright position. The foot pump also includes a release means to retract the arms when removing the tree.

The stand also includes an electronic housing 12 having two opposing parallel sections with a space therebetween. A first water permeable section 13 vertically extends into the interior chamber of the base component having a magnetic reed float switch 14 received therein. The magnetic reed float switch moves up and down within the first section depending upon the water level 27 in the interior chamber. When the water level diminishes below a predetermined level, the switch engages a contact on the bottom of the first section. The contact is in communication with an alarm means that audibly or visually alerts a user that water should be added to the base component.

The opposing section 15 of the electronics housing is disposed along the exterior of the base component side wall and includes a plurality of electrical receptacles thereon each in communication with a circuit-breaker switch (not pictured). Extending from the top of the electronics housing is a wire 16 having a Christmas tree ornament 17 at a distal end, the ornament being attachable to a tree branch. The ornament includes a fire detection means 18 such as a smoke detector, fire detector or a heat detector in communication with an alarm circuit and a speaker 19 for emitting an audible signal in the event of a fire. The ornament also includes a light 20 in communication with the smoke alarm and the reed switch contact for emitting a visual alarm in the event that a fire is occurring or that water within the base component interior chamber has diminished below a predetermined level.

The second section also includes a plurality of buttons. A first button 21 provides power to the device via an electrical cord 22. A second, three position switch 23 activates the fire detection means to selectively emit an audible alarm via the speaker, a visual alarm via the light or both. A third, three position switch 24 activates the reed switch contact to interchangeably emit an audible alarm, a visual alarm or both in the event of a low water level.

The various components of the above described device may be constructed with any suitable materials. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A Christmas tree stand comprising:

a hollow, substantially bowl shaped base component having a bottom wall, a continuous side wall depending therefrom and an open top end in communication with an interior chamber for receiving a tree trunk and a predetermined amount of water therein;

a vertically disposed fixed plate received within said interior chamber;

a pair of substantially horizontal telescoping arms secured to said base component and extending into the interior chamber, said arms each having an engagement plate at a distal end;

a foot actuated air pump in communication with said arms for selectively extending said arms to thrust said plates against a tree trunk;

a water level sensing means for alerting a user when the water level within said interior chamber has diminished below a predetermined level;

a fire alarm means for signalling a user in the event of a fire;

an electronics housing mounted on said base component, a first portion of which extends into said interior chamber, said first portion having a contact on a lower end in communication with an audible alarm means and a visual alarm means;

a magnetic reed float switch received within said first section for engaging said contact to activate either of said alarm means upon said water level diminishing below a predetermined level;

said electronics housing further including a second section external from said interior chamber having a plurality of electrical receptacles thereon;

a circuit breaker switch in communication with said electrical receptacles.

2. A device according to claim 1 wherein said fire alarm means comprises an ornament attachable to a tree branch having a smoke detector thereon in communication with the audible alarm means and the visual alarm means.

3. A device according to claim 2 wherein each plate on said telescoping arms slide within a guide track received within the interior chamber to provide a path on which said plates slide.

* * * * *